United States Patent [19]

Kahn

[11] 4,361,734

[45] Nov. 30, 1982

[54] HEARING AID

[76] Inventor: Arthur R. Kahn, 1218 Drexel Ave., Miami Beach, Fla. 33139

[21] Appl. No.: 170,604

[22] Filed: Jul. 21, 1980

[51] Int. Cl.[3] ..... H04R 25/00

[52] U.S. Cl. ..... 179/107 R

[58] Field of Search ..... 179/107 R, 107 E, 107 H, 179/107 S

[56] References Cited

U.S. PATENT DOCUMENTS 2,461,344 2/1949 Olson ..... 179/107 R 4,259,547 3/1981 Valley et al. ..... 179/107 H

*Primary Examiner*—George G. Stellar

*Attorney, Agent, or Firm*—John Cyril Malloy

[57] ABSTRACT

An improved hearing aid which is composed of a first and a second hearing aid amplifier circuit interconnected by a sound conducting tube and wherein the second hearing aid amplifier circuit includes a sound conducting tube to provide sound to the ear of a wearer and wherein the hearing aid amplifier circuits are housed within an ear mold housing.

1 Claim, 2 Drawing Figures

HEARING AID

FIELD OF THE INVENTION

This invention relates to hearing aids.

BACKGROUND OF THE INVENTION

In the past persons using hearing aids have had difficulties. This invention is of an improved hearing aid and is composed of a first and second hearing aid amplifier circuit, in series with one another, with the sound output of the first hearing aid amplifier circuit being provided through a sound conducting tube to the second hearing aid amplifier circuit to be amplified and utilized to increase the sound output of the device, all of which is housed within a housing and ear mold in combination for increased hearing ability.

OBJECTS OF THE INVENTION

It is an object of this invention to provide an improved hearing aid amplifier device composed of a first and second hearing aid amplifier circuit wherein the first hearing aid amplifier circuit is arranged and adapted to provide sound to be reamplified to a second hearing amplified circuit and provided to the ear of a wearer through a microphone, all of the same being embodied within a housing composed of an ear mold to be fitted into the ear of a wearer.

In accordance with these and other objects which will become apparent hereinafter, the instant invention will now be described with reference to the accompanying drawings in which:

DESCRIPTION OF THE PREFERRED EMBODIMENT

Figure 1:
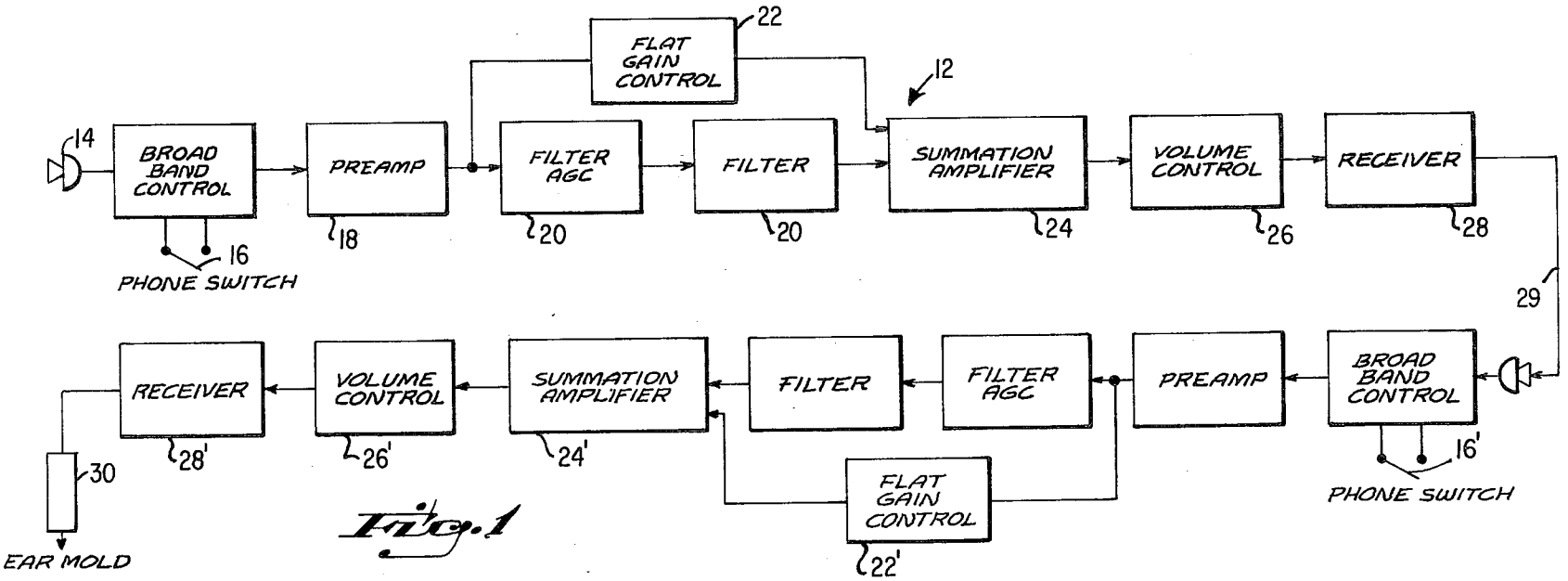
FIG. 1 is a schematic view illustrating the instant invention.
Figure 2:
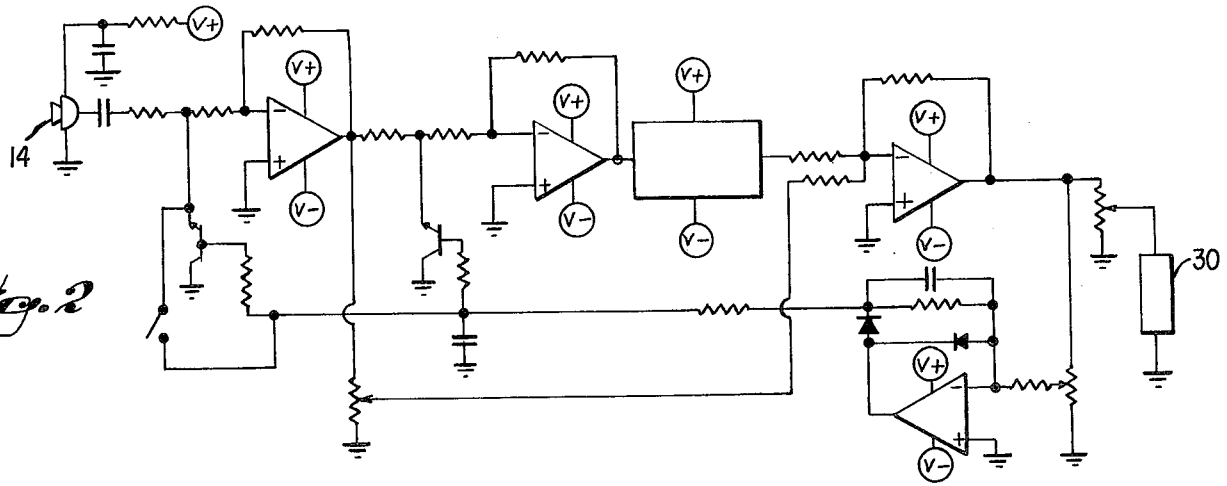
FIG. 2 is a circuit diagram illustrating the instant invention.

Referring to the drawings wherein like reference characters designate like or corresponding parts throughout the several views, and referring particularly to FIG. 1, there is shown a hearing aid in accordance with this invention which includes two systems, generally, which it has been found increases the ability of persons to hear. It includes a first hearing aid amplifier circuit generally designated by the numeral 12 which includes a microphone 14 and a broad band control with a phone switch generally designated by the numeral 16. In series therewith is a preamplifier 18 and a first and second filter in series with one another and, in parallel with the filters, a flat gain control 22. The output of these parallel elements is provided to a summation amplifier 24 and volume control 26 and, hence, to a receiver 28 and an output conductor 29. Contrary to existing equipment, there is provided a second hearing aid amplifier circuit, similar to the first and in series therewith which includes the switch 16', broad band control 18' preamp, filters 20' in parallel with the flat gain control 22', summation amplifier 24' and volume control 26' as well as receiver 28' which leads to the ear mold 30. In use, the device is installed in the ear of a wearer and the microphone 14 which is doubly amplified provides the sound for the person using the device. The circuit diagram for the device is as shown in FIG. 2, the elements being shown by conventional circuit diagram.

It has been found that the utilization of the two hearing amplifier circuits in series with one another provides for increased sound and improved hearing which has been a problem of persons using hearing aids in the past and there is, in addition to a mere summing of the outputs, a highly improved capability which is afforded by the device.

What is claimed is:

1. A hearing aid device composed of a first hearing aid amplifier including a microphone, a receiver and means conducting the two together including amplifier means, filter means, and a summation amplifier;

a second hearing aid amplifier circuit including a hearing aid device composed of a first hearing aid amplifier including a microphone, a receiver and means conducting the two together including amplifier means, filter means, and a summation amplifier;

a sound conducting tube interconnecting the receiver of the first hearing aid and the microphone of the second hearing aid to conduct sound from the first hearing aid amplifier circuit to the second hearing aid amplifier circuit to be reamplified by the second hearing aid amplifier circuit; and an ear mold;

a housing for the hearing aid amplifier circuits and the tube and a sound conducting tube interconnecting the second hearing aid receiver and the ear mold to provide dual amplified sound to the ear of a wearer.

* * * * *